US009885099B2

(12) United States Patent
Kanno et al.

(10) Patent No.: US 9,885,099 B2
(45) Date of Patent: Feb. 6, 2018

(54) FERRITIC STAINLESS STEEL SHEET

(71) Applicant: NIPPON STEEL & SUMIKIN STAINLESS STEEL CORPORATION, Tokyo (JP)

(72) Inventors: Norihiro Kanno, Tokyo (JP); Junichi Hamada, Tokyo (JP); Yoshiharu Inoue, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 481 days.

(21) Appl. No.: 14/384,121

(22) PCT Filed: Mar. 8, 2013

(86) PCT No.: PCT/JP2013/056531
§ 371 (c)(1),
(2) Date: Sep. 9, 2014

(87) PCT Pub. No.: WO2013/133429
PCT Pub. Date: Sep. 12, 2013

(65) Prior Publication Data

US 2015/0044085 A1 Feb. 12, 2015

(30) Foreign Application Priority Data

Mar. 9, 2012 (JP) ..... 2012-053262
Feb. 8, 2013 (JP) ..... 2013-023416

(51) Int. Cl.
*C22C 38/04* (2006.01)
*C22C 38/00* (2006.01)
(Continued)

(52) U.S. Cl.
CPC ..... *C22C 38/04* (2013.01); *C21D 6/002* (2013.01); *C21D 6/02* (2013.01); *C21D 8/0436* (2013.01);
(Continued)

(58) Field of Classification Search
CPC . C22C 38/00–38/48; C21D 9/00; C21D 9/46; C21D 6/00; C21D 6/02; C21D 6/002; C21D 8/00; F01N 2530/04
See application file for complete search history.

(56) References Cited

U.S. PATENT DOCUMENTS 5,626,694 A 5/1997 Kawabata et al.
2001/0003293 A1 6/2001 Hirata et al.
(Continued)

FOREIGN PATENT DOCUMENTS

CA 2697138 A1 2/2009
CA 2707518 A1 7/2009
(Continued)

OTHER PUBLICATIONS

International Search Report issued in PCT/JP2013/056531, dated May 28, 2013.
(Continued)

*Primary Examiner* — Jennifer A Smith
*Assistant Examiner* — Alexandra M Moore
(74) *Attorney, Agent, or Firm* — Birch, Stewart, Kolasch & Birch, LLP

(57) ABSTRACT

To provide a ferritic stainless steel sheet which has high scale spalling even at a high temperature around 1000° C. Provided is a ferritic stainless steel sheet having excellent Mn-containing oxide film-forming ability and scale spalling ability, containing, in terms of mass %: C: 0.001 to 0.020%, N: 0.001 to 0.020%, Si: 0.10 to 0.40%, Mn: 0.20 to 1.00%, Cr: 16.0 to 20.0%, Nb: 0.30 to 0.80%, Mo: 1.80 to 2.40%,
(Continued)

W: 0.05 to 1.40%, Cu: 1.00 to 2.50%, and B: 0.0003 to 0.0030%, in which the above-mentioned components are contained satisfying the formula (1) below, and the balance is composed of Fe and inevitable impurities. At least one of N, Al, V, Mg, Sn, Co, Zr, Hf, and Ta may be added in a predetermined content range.

$$3 \leq (5 \times Mo)/(3 \times Mn) \leq 20 \quad (1)$$

7 Claims, 3 Drawing Sheets

(51) Int. Cl.

| | |
|---|---|
| ***C22C 38/32*** | (2006.01) |
| ***C22C 38/54*** | (2006.01) |
| ***C22C 38/02*** | (2006.01) |
| ***C22C 38/20*** | (2006.01) |
| ***C22C 38/22*** | (2006.01) |
| ***C22C 38/26*** | (2006.01) |
| ***C21D 6/00*** | (2006.01) |
| ***C21D 6/02*** | (2006.01) |
| ***C21D 8/04*** | (2006.01) |
| ***C22C 38/06*** | (2006.01) |
| ***C22C 38/24*** | (2006.01) |
| ***C22C 38/28*** | (2006.01) |
| ***C22C 38/30*** | (2006.01) |
| ***C22C 38/42*** | (2006.01) |
| ***C22C 38/44*** | (2006.01) |
| ***C22C 38/48*** | (2006.01) |
| *C21D 9/46* | (2006.01) |

(52) U.S. Cl.

CPC ..... *C21D 8/0473* (2013.01); *C21D 8/0478* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/44* (2013.01); *C22C 38/48* (2013.01); *C22C 38/54* (2013.01); *C21D 9/46* (2013.01); *F01N 2530/04* (2013.01)

(56) References Cited

U.S. PATENT DOCUMENTS

| | | | |
|---|---|---|---|
| 2004/0170518 | A1 | 9/2004 | Oku et al. |
| 2005/0161133 | A1 | 7/2005 | Hamada et al. |
| 2005/0173033 | A1 | 8/2005 | Yazawa et al. |
| 2008/0138233 | A1 | 6/2008 | Tomita et al. |
| 2008/0199638 | A1 | 8/2008 | Lin et al. |
| 2009/0000703 | A1 | 1/2009 | Hamada et al. |
| 2009/0092513 | A1 | 4/2009 | Hamada et al. |
| 2009/0120536 | A1* | 5/2009 | Tomita ..... C22C 38/04 148/326 |
| 2009/0136378 | A1 | 5/2009 | Satou et al. |
| 2010/0108200 | A1 | 5/2010 | Futamura et al. |
| 2010/0272594 | A1 | 10/2010 | Hiraide |
| 2011/0061777 | A1 | 3/2011 | Ishii et al. |
| 2011/0110812 | A1 | 5/2011 | Hiraide et al. |
| 2011/0176954 | A1 | 7/2011 | Oku et al. |
| 2012/0014830 | A1 | 1/2012 | Hamada et al. |
| 2012/0020827 | A1 | 1/2012 | Nakamura et al. |
| 2013/0004360 | A1 | 1/2013 | Kanno et al. |
| 2013/0017116 | A1 | 1/2013 | Hatano et al. |
| 2013/0129560 | A1 | 5/2013 | Matsuhashi et al. |
| 2014/0023550 | A1 | 1/2014 | Hamada et al. |
| 2015/0044085 | A1 | 2/2015 | Kanno et al. |

FOREIGN PATENT DOCUMENTS

| | | | |
|---|---|---|---|
| CN | 1380150 | A | 11/2002 |
| CN | 1550565 | A | 12/2004 |
| CN | 10145054 | A | 5/2009 |
| CN | 1788102 | A | 6/2009 |
| CN | 101454471 | A | 6/2009 |
| CN | 101538683 | A | 9/2009 |
| CN | 101784686 | A | 7/2010 |
| CN | 101845803 | A | 9/2010 |
| CN | 102131948 | A | 7/2011 |
| CN | 102361999 | A | 2/2012 |
| EP | 0478790 | A1 | 4/1992 |
| EP | 0683241 | A2 | 11/1995 |
| EP | 1249513 | A1 | 10/2002 |
| EP | 1477574 | A2 | 11/2004 |
| EP | 1930461 | A1 | 6/2008 |
| EP | 2112245 | A1 | 10/2009 |
| EP | 2351866 | A1 | 8/2011 |
| JP | 59-159974 | A | 8/1984 |
| JP | 63-182818 | A | 7/1988 |
| JP | 3-274245 | A | 12/1991 |
| JP | 4-218823 | A | 8/1992 |
| JP | 5-33104 | A | 2/1993 |
| JP | 6-70897 | A | 3/1993 |
| JP | 5-320764 | A | 12/1993 |
| JP | 7-41854 | A | 2/1995 |
| JP | 8-41600 | A | 2/1996 |
| JP | 8-60303 | A | 3/1996 |
| JP | 8-74073 | A | 3/1996 |
| JP | 8-189235 | A | 8/1996 |
| JP | 8-199237 | A | 8/1996 |
| JP | 9-279312 | A | 10/1997 |
| JP | 10-237602 | A | 9/1998 |
| JP | 2896077 | B2 | 5/1999 |
| JP | 2000-178593 | A | 6/2000 |
| JP | 3067577 | B2 | 7/2000 |
| JP | 2001-26826 | A | 1/2001 |
| JP | 2001-181798 | A | 7/2001 |
| JP | 3242007 | B2 | 12/2001 |
| JP | 2002-30346 | A | 1/2002 |
| JP | 2002-275596 | A | 9/2002 |
| JP | 2004-218013 | A | 8/2004 |
| JP | 2004-232074 | A | 8/2004 |
| JP | 2004-270025 | A | 9/2004 |
| JP | 2006-171377 | A | 6/2005 |
| JP | 2006-37176 | A | 2/2006 |
| JP | 2006-117985 | A | 5/2006 |
| JP | 2006-233278 | A | 9/2006 |
| JP | 2006-328525 | A | 12/2006 |
| JP | 3926492 | B2 | 6/2007 |
| JP | 2008-187631 | A | 5/2008 |
| JP | 2008-138270 | A | 6/2008 |
| JP | 2008-144189 | A | 6/2008 |
| JP | 2008-189974 | A | 6/2008 |
| JP | 2008-190003 | A | 8/2008 |
| JP | 2008-248328 | A | 10/2008 |
| JP | 2008-291282 | A | 12/2008 |
| JP | 2008-297531 | A | 12/2008 |
| JP | 2009-1834 | A | 1/2009 |
| JP | 2009-68113 | A | 4/2009 |
| JP | 2009-102728 | A | 5/2009 |
| JP | 2009-120893 | A | 6/2009 |
| JP | 2009-120894 | A | 6/2009 |
| JP | 2009-167443 | A | 7/2009 |
| JP | 2009-120894 | A | 8/2009 |
| JP | 2009-174040 | A | 8/2009 |
| JP | 2009-174048 | A | 8/2009 |
| JP | 2009-197306 | A | 9/2009 |
| JP | 2009-197307 | A | 9/2009 |
| JP | 2009-215648 | A | 9/2009 |
| JP | 2009-235555 | A | 10/2009 |
| JP | 2010-100877 | A | 5/2010 |
| JP | 2010-106323 | A | 6/2010 |
| JP | 2010-121208 | A | 6/2010 |

(56) References Cited

FOREIGN PATENT DOCUMENTS

| | | | |
|---|---|---|---|
| JP | 2010-156039 | A | 7/2010 |
| JP | 2011-68948 | A | 4/2011 |
| JP | 4702493 | B1 | 5/2011 |
| JP | 2011-140709 | A | 7/2011 |
| JP | 2011-179114 | A | 9/2011 |
| JP | 2011-179116 | A | 9/2011 |
| JP | 2011-180468 | A | 9/2011 |
| JP | 2011-190524 | A | 9/2011 |
| JP | 2011-246813 | A | 12/2011 |
| JP | 2012-117084 | A | 6/2012 |
| JP | 2012-140687 | A | 7/2012 |
| JP | 2012-140688 | A | 7/2012 |
| JP | 2012-207252 | A | 10/2012 |
| JP | 2013-213279 | A | 10/2013 |
| KR | 10-2001-0082057 | A | 7/2001 |
| KR | 2002-0045322 | A | 6/2002 |
| KR | 10-2011-0115619 | A | 10/2011 |
| WO | WO 95/20683 | A1 | 8/1995 |
| WO | WO 03/004714 | A1 | 1/2003 |
| WO | WO 2004/053171 | A | 6/2004 |
| WO | WO 2011/024568 | A1 | 3/2011 |
| WO | WO 2011/098454 | A1 | 6/2011 |
| WO | WO 2011/111871 | A1 | 9/2011 |
| WO | WO 2011/122513 | A1 | 10/2011 |
| WO | WO 2012/018074 | A1 | 2/2012 |
| WO | WO 2012/108473 | A1 | 8/2012 |
| WO | WO 2012/133573 | A1 | 10/2012 |

OTHER PUBLICATIONS

Kato et al., "Development of a Ferritic Stainless Steel with Excellent Heat Resistance", Transactions of the Society of Automotive Engineers of Japan, Mar. 25, 2008, vol. 39, No. 2, pp. 329-333.

Chinese Office Action and Search Report for Chinese Application No. 201380006138.6, dated Jul. 27, 2015, including and English translation.

Chinese Office Action and Search Report for Chinese Application No. 201380008761.5, dated Aug. 5, 2015, including an English translation of the Search Report.

International Search Report and Written Opinion of the International Searching Authority (Forms PCT/ISA/210 and PCT/ISA/237) for International Application No. PCT/JP2014/055753, dated Apr. 22, 2014, including and English translation.

International Search Report and Written Opinion of the International Searching Authority (Forms PCT/ISA/210 and PCT/ISA/237) for International Application No. PCT/JP2013/068856, dated Jun. 11, 2013, including an English translation.

International Search Report for International Application No. PCT/JP2013/053665, dated May 7, 2013, including and English translation.

Canadian Office Action for Canadian Application No. 2,861,030, dated Nov. 25, 2015.

Canadian Office Action for Canadian Application No. 2,866,136, dated Feb. 12, 2016.

Chinese Office Action and Search Report for Chinese Application No. 201280046386.9, dated Jun. 1, 2015, including and English translation.

Chinese Office Action and Search Report for Chinese Application No. 201480006916.6, dated Apr. 1, 2016, including an English translation of the Search Report.

International Search Report for International Application No. PCT/JP2012/081693, dated Mar. 6, 2013, including an English translation.

International Search Report for International Application No. PCT/JP2014/059011, dated Jun. 3, 2014.

Ito et al., "Development of Automatic Analyzer for Sulfuric Acid, Mixed Nitric Acid, and Hydrofluoric Acid in Stainless Pickling Process," Kagaku Kogaku Ronbunshu, vol. 25, No. 1, 1999, pp. 1-6, Including and English Abstract.

Japanese Notice of Reasons for Rescission for Japanese Application No. 2013-548300, dated Oct. 31, 2016, with a partial English translation.

Japanese Office Action for Japanese Application No. 2013-027127, dated Jan. 12, 2016, with partial English translation.

Japanese Office Action for Japanese Application No. 2013-027127, dated Jul. 12, 2016, along with an English translation.

Japanese Opposition No. 2016-700854 for Japanese Application No. 2013-548300, dated Aug. 24, 2016, including partial English translation.

JFE Steel Corporation, Stainless Steel for Automobile Brochure, retrieved Dec. 31, 2015, pp. 1-23 (25 pages provided), including a partial English translation.

Korean Notice of Allowance for Korean Applicaiton No. 10-2015-7020744, dated Dec. 6, 2016, with an English translation.

Korean Notice of Preliminary Rejection for Korean Application No. 10-2014-7023338, dated Aug. 17, 2015, with a partial English translation.

Nisshin Steel Co., Ltd., Stainless Steel Brochure, retrieved Dec. 31, 2015, pp. 1-15 (16 pages provided), with partial English translation.

Partial English translation of Japanese Opposition No. 2016-700854 for Japanese Application No. 2013-548300, dated Aug. 24, 2016.

Portion of Japanese Patent No. 4167166 B2, dated Oct. 5, 2006, submitted by Third Party, including an English translation.

Third Party Observation Notification for International Application No. PCT/JP2012/081693, dated Nov. 22, 2013.

U.S. Office Action for U.S. Appl. No. 14/355,117, dated Feb. 9, 2016 (Final Rejection).

U.S. Office Action for U.S. Appl. No. 14/355,117, dated Mar. 27, 2017 (Non-Final Rejection).

U.S. Office Action for U.S. Appl. No. 14/355,117, dated Oct. 22, 2015 (Non-Final Rejection).

U.S. Office Action for U.S. Appl. No. 14/374,497, dated Aug. 8, 2016 (Non-Final Rejection).

U.S. Office Action for U.S. Appl. No. 14/374,497, dated Jan. 13, 2017 (Final Rejection).

U.S. Office Action for U.S. Appl. No. 14/383,434, dated Dec. 6, 2016 (Non-Final Rejection).

U.S. Office Action for U.S. Appl. No. 14/383,434, dated Jan. 7, 2016 (Non-Final Rejection).

U.S. Office Action for U.S. Appl. No. 14/383,434, dated Jun. 16, 2016 (Final Rejection).

U.S. Office Action for U.S. Appl. No. 14/383,434, dated Jun. 9, 2017 (Final Rejection).

U.S. Office Action for U.S. Appl. No. 14/383,434, dated Oct. 27, 2016 (Advisory Action).

U.S. Office Action for U.S. Appl. No. 14/766,296, dated Jun. 15, 2017 (Final Rejection).

U.S. Office Action for U.S. Appl. No. 14/766,296, dated Mar. 20, 2017 (Non-Final Rejection).

U.S. Office Action for U.S. Appl. No. 14/969,310, dated Jun. 29, 2016 (Final Rejection).

U.S. Office Action for U.S. Appl. No. 14/969,310, dated Mar. 2, 2016 (Non-Final Rejection).

U.S. Office Action for U.S. Appl. No. 14/383,434, dated Sep. 29, 2017 (Non Final Rejection).

U.S. Office. Action for U.S. Appl. No. 14/766,296, dated Dec. 6, 2017 (Non-Final Rejection).

U.S. Office Action for U.S. Appl. No. 14/989,310, dated Dec. 1. 2017 (Final Rejection).

U.S. Office Action for U.S. Appl. No. 15/726,722, dated Dec. 11, 2017 (Non-Final Rejection).

* cited by examiner

FERRITIC STAINLESS STEEL SHEET

TECHNICAL FIELD

The present invention relates to a ferritic stainless steel sheet which is particularly used for exhaust system members or the like that need oxidation resistance.

BACKGROUND ART

Since an exhaust system member such as an exhaust manifold for automobiles allows a high temperature exhaust gas which is emitted from an engine to pass, a material which constitutes the exhaust member needs a variety of characteristics such as high temperature strength, oxidation resistance, and thermal fatigue characteristics, and thus a ferritic stainless steel having an excellent heat resistance is employed for the material.

The exhaust gas temperature varies depending on the vehicle type, and, in recent years, is approximately 800 to 900° C. in many cases. The temperature of an exhaust manifold which allows a high temperature exhaust gas emitted from an engine to pass is as high as 750 to 850° C. With the emergence of environmental problems in recent years, further progression in strengthening exhaust gas regulations and improvement of fuel efficiency is proceeding. As the result, the exhaust gas temperature is believed to be elevated to about 1000° C.

Examples of a ferritic stainless steel which is used in recent years include SUS429 (JIS standard, Nb—Si-added steel) and SUS444 (JIS standard, Nb—Mo-added steel), which improve high temperature strength and oxidation resistance by addition of Nb as a principle element, Si, and Mo. However, SUS444 does not have sufficient high temperature strength and oxidation resistance for the temperature of an exhaust gas higher than 850° C. For this reason, a ferritic stainless steel having a temperature strength and oxidation resistance of SUS444 or higher is demanded. Herein, "oxidation resistance" is evaluated by increased amount of oxidation and the amount of spalled scale in a continuous oxidation test in the air, and it is assumed to be excellent when both the increased amount of oxidation and the amount of spalled scale are small. Since automobiles are used for a long period of time, oxidation resistance in cases in which a ferritic stainless steel is maintained at 1000° C. for 200 hours is needed.

For such a demand, a variety of materials for a exhaust system member have been developed. For example, Patent Documents 1 to 4 disclose a technique in which Cu—Mo—Nb—Mn—Si are added in combination. To the steel disclosed in Patent Document 1, Cu—Mo are added for the purpose of improving high temperature strength and toughness, and Mn is added for the purpose of improving scaling resistance. However, increased amount of oxidation is not clearly described, the conditions of a continuous oxidation test are 1000° C.×100 hours, and scale spalling ability in a case of exceeding 100 hours is not examined. Patent Document 2 discloses mutual adjustment of elements to be added for improving oxidation resistance of Cu-added steel. However, the temperature of the continuous oxidation test is not higher than 950° C., and a test at 1000° C. is not actually conducted. Patent Document 3 discloses a method in which repeated oxidation characteristics of steel is dramatically improved by optimizing the contents of Si and Mn. However, the total heat treatment time in the repeated oxidation test at the highest temperature is about 133 hours, and examination of oxidation resistance in a longer period of time has not been carried out. Although Patent Document 4 discloses a technique that high temperature strength and oxidation resistance are improved by adjusting the amounts of Mo and W, only the increased amount of oxidation is evaluated and the amount of spalled scale is not evaluated.

The present inventors disclose in Patent Document 5 a technique that Laves phase and ϵ-Cu phase are finely dispersed by adding Nb—Mo—Cu—Ti—B in combination to obtain high temperature strength at 850° C. The present inventors also disclose in Patent Document 6 a technique in which precipitation and coarsening of Laves phase are inhibited by making a carbonitride having Nb as a main phase fine in a Nb—Mo—Cu—Ti—B steel to obtain an excellent heat resistance at 950° C.

PRIOR ART DOCUMENTS

Patent Document

Patent Document 1 Japanese Patent No. 2696584

Patent Document 2 Japanese Laid-open Patent Publication No. 2009-235555

Patent Document 3 Japanese Laid-open Patent Publication No. 2010-156039

Patent Document 4 Japanese Laid-open Patent Publication No. 2009-1834

Patent Document 5 Japanese Laid-open Patent Publication No. 2009-215648

Patent Document 6 Japanese Laid-open Patent Publication No. 2011-190468

SUMMARY OF INVENTION

Problems to be Solved by Invention

It has been found that even when the techniques disclosed in Patent Documents 5 and 6 are used, there are some cases in which oxidation resistance and scale spalling ability are not stably exhibited at a long period of time in a temperature of around 1000° C.

An object of the present invention is to provide ferritic stainless steel having a higher oxidation resistance than a conventional art particularly in an environment in which the highest temperature of an exhaust gas is around 1000° C.

The following description is not intended to limit the invention.

Means for Solving the Problem

In order to solve the above-mentioned problem, the present inventors intensively studied to find that, in a Si—Mn—Nb—Mo—W—Cu-added steel, in cases in which the amount of Mo to be added is 1.80% or higher, when the amount of Mn to be added is increased and further, the balance between Mo and Mn is controlled such that the following formula (1):

$$3 \leq (5 \times Mo)/(3 \times Mn) \leq 20 \quad (1)$$

is satisfied, the increased amount of oxidation and the amount of spalled scale during a long time use at 1000° C. are small and the long term stability of an oxide film is excellent. It is also found that when Ti is contained the scale spalling ability is deteriorated.

The present inventors smelted Si—Mn—Nb—Mo—W—Cu-added steels of many types of compositions to produce sheet materials and test pieces were cut out, and the increased amount of oxidation and the amount of spalled scale during a long time use at 1000° C. were evaluated. As the result of the evaluation, it has been found that Si—Mn—Nb—Mo—W—Cu-added steels having two or three types of compositions have an excellent long term stability of an oxide film. From the above steels, a steel having the most excellent long term stability of an oxide film is selected, and the relationship between the increased amount of oxidation and the amount of spalled scale during a long time use at 1000° C. and the chemical composition has been clarified.

In other words, as a Si—Mn—Nb—Mo—W—Cu-added steel which is a steel having an excellent long term stability of the above-mentioned oxide film, a 0.005 to 0.008% C-0.009 to 0.013% N-16.9 to 17.5% Cr-0.13 to 0.19% Si-0.03 to 1.18% Mn-0.49 to 0.55% Nb-2.14 to 2.94% Mo-0.67 to 0.80% W-1.40 to 1.55% Cu-0.0003 to 0.0006B steel was employed. FIG. 1 illustrates an examination result of the amount of spalled scale when a continuous oxidation test in the air is performed at 1000° C. for 200 hours. In a steel type whose amount of Mn added was 0.20% or larger, it has been found that when the amount of spalled scale becomes small to be 0.30% or higher, the amount of spalled scale is substantially 0. FIG. 2 illustrates a relationship when the above-mentioned result is applied to the Mo/Mn ratio (middle term of formula (1), (5×Mo)/(3×Mn)). It has been found that when the Mo/Mn ratio is 20 or smaller, the amount of spalled scale is 1.0 mg/cm$^2$ or smaller and an excellent scale spalling ability can be obtained. The reason why the long term stability of an oxide film is excellent when Mn is added is that the component composition of the steel of the invention has an excellent Mn-containing oxide film-forming ability. Since the steel is exposed to a high temperature for a long time, $(Mn, Cr)_3O_4$ which is generated on the outermost layer as an oxide film is generated to form a thick scale. As the result, it is assumed that generation and sublimation of $MoO_3$ which easily sublimes are inhibited, and scale defect is hardly to occur, and a scale is hardly to be spalled. In order to confirm the existence of the Mn-containing oxide film, a cross section after a heat treatment is subjected to elemental mapping by EPMA, and the existence can be judged by whether Mn is concentrated at the outermost layer or not.

In the present invention, it is confirmed that, when a heat treatment is performed in a condition of 900 to 1000° C.×100 to 200 hours, $(Mn, Cr)_3O_4$ is generated on the outermost layer of the oxide film. A heat treatment condition in which the progression of oxidation is considerable and an influence of abnormal oxidation is excluded was set to a heat treatment of evaluation criteria.

Further, it has been found that, when the amount of W is controlled such that the formula (2):

$$2.28 \leq (5\times Mo+2.5W)/(4\times Mn) \leq 8.0 \quad (2)$$

is satisfied, the increased amount of oxidation and the amount of spalled scale during a long time use at 1000° C. are small and the oxide film has an excellent long term stability, in other words, the influence of W on the scaling resistance is ½ of the amount of Mo added.

Further, FIG. 3 illustrates the result of a continuous oxidation test in the air of steel selected as the above-mentioned oxide film having an excellent long term stability. In other words, FIG. 3 illustrates a relationship in which the amount of spalled scale in cases in which a continuous oxidation test in the air at 1000° C. for 200 hours is performed by using a 0.005 to 0.007% C-0.0010 to 0.012% N-17.4 to 17.8% Cr-0.13 to 0.15% Si-0.03 to 1.18% Mn-0.49 to 0.56% Nb-1.81 to 2.15% Mo-0.35 to 0.70% W-1.40 to 1.53% Cu-0.0004 to 0.0005B steel is applied to the Mo.W/Mn ratio (middle term of the formula (2), ((5×Mo+2.5W)/(4×Mn)). In FIG. 3, • (filled circle) represents that the formula (1) is satisfied, and O (open circle) represents that the formula (1) is not satisfied. It has been found that, when the middle term of the formula (2) is 8.0 or smaller in data in which formula (1) is satisfied, a scale is hardly spalled. This is because, in a similar manner to Mo, generation and the above-mentioned sublimation of $WO_3$ which easily sublimes are inhibited by a scale containing $(Mn, Cr)_3O_4$. For this reason, it is assumed that a scale defect is hardly to be generated, and a scale is hardly to be spalled.

A summary of the invention is as follows.

(1) A Mn-containing ferritic stainless steel sheet containing, in terms of mass %:
C: 0.001 to 0.020%,
N: 0.001 to 0.020%,
Si: 0.10 to 0.40%,
Mn: 0.20 to 1.00%,
Cr: 16.0 to 20.0%,
Nb: 0.30 to 0.80%,
Mo: 1.80 to 2.40%,
W: 0.05 to 1.40%,
Cu: 1.00 to 2.50%, and
B: 0.0003 to 0.0030%, in which the above-mentioned components are contained satisfying the formula (1) below:

$$5 \leq (5\times Mo)/(3\times Mn) \leq 20 \quad (1),$$

and the balance is composed of Fe and inevitable impurities, wherein Mo and Mn in the formula (1) each mean the content (mass %) thereof.

(2) The Mn-containing ferritic stainless steel sheet according to (1), wherein the above-mentioned components are contained satisfying the formula (2) below:

$$2.28 \leq (5\times Mo+2.5\times W)/(4\times Mn) \leq 8.0 \quad (2),$$

wherein Mo, Mn, and W in the formula (2) each mean the content (mass %) thereof.

(3) The Mn-containing ferritic stainless steel sheet according to (1) or (2), containing a component selected from at least one group of
a first group containing one or two or more of
Ni: 0.10 to 1.0%,
Al: 0.01 to 1.0%, and
V: 0.01 to 0.50%;
a second group containing
Mg: 0.00010 to 0.0100%;
a third group containing one or two of
Sn: 0.01 to 0.50% and
Co: 0.01 to 1.50%; and
a fourth group containing one or two or more of
Zr: 0.01 to 1.0%,
Hf: 0.01 to 1.0%, and
Ta: 0.01 to 2.0%.

(4) The Mn-containing ferritic stainless steel sheet having Mn-containing oxide film-forming ability and scale spalling ability according to any one of (1) to (3), wherein $(Mn, Cr)_3O_4$ is generated on the outermost layer of an oxide film when a heat treatment is performed in a condition of 900 to 1000° C.×100 to 200 hours.

(5) The Mn-containing ferritic stainless steel sheet according to (1) to (4), wherein the amount of spalled scale in cases in which the ferritic stainless steel sheet according to (1) to (3) is subjected to a continuous oxidation test in the air at 1000° C. for 200 hours is 1.0 mg/cm$^2$ or smaller.

Those without a lower limit include the level of inevitable impurities.

Effect of the Invention

According to the invention, high temperature characteristics better than SUS444 are obtained, in other words, ferritic stainless steel having better oxidation resistance at 1000° C. than SUS444 can be provided. By applying the invention particularly to an exhaust system member of an automobile or the like, the exhaust system member can deal with an exhaust gas with a high temperature around 1000° C.

DESCRIPTION OF EMBODIMENTS

Figure 1:
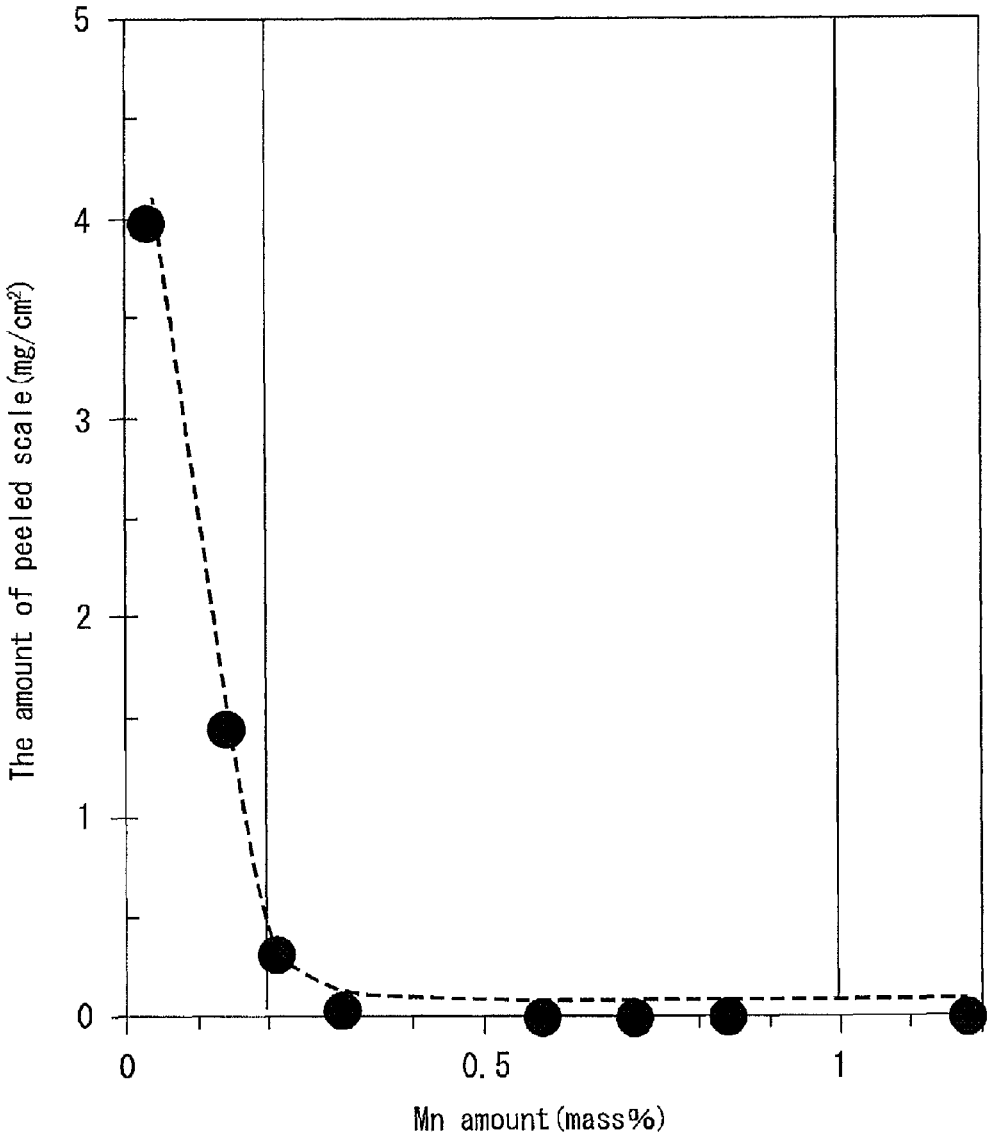
FIG. 1 illustrates a result representing the amount of Mn added and the amount of spalled scale.

In the following, the present invention is described in detail. First, the reason for restricting the components of the invention is explained in detail. Hereinafter, % means mass % unless otherwise restricted C deteriorates formability and corrosion resistance, and accelerates precipitation of Nb carbonitride to cause decrease in high temperature strength. The smaller the content the better. From the above-mentioned reason, preferably, the upper limit of the content is 0.020%, suitably 0.015%, and more suitably 0.012%.

Note that, since an excessive decrease in the content leads to an increase in refining cost, preferably the lower limit is 0.001%, suitably 0.002%, and more suitably 0.003%.

N, in a similar manner to C, deteriorates formability and corrosion resistance, and accelerates precipitation of Nb carbonitride to cause decrease in high temperature strength. The smaller the content, the better, and therefore, the content was set to 0.020% or smaller. From the above-mentioned reason, the upper limit was suitably 0.015%, and further suitably 0.012%. Note that, since an excessive decrease in the content leads to an increase in refining cost, preferably the lower limit is 0.001%, suitably 0.003%, and more suitably 0.005%.

Si is a very important element for improving oxidation resistance. Si is an element which is also useful as a deoxidizer. When the amount of Si added is smaller than 0.10%, abnormal oxidation tends to occur; when the amount of Si added is larger than 0.40%, scale spalling tends to occur; and therefore, the amount was set to 0.10 to 0.40%. From the above-mentioned reason, preferably the upper limit is suitably 0.30%, and further suitably 0.25%. However, in consideration of high temperature strength, assuming that Si accelerates precipitation of an intermetallic compound containing Fe, Nb, Mo, and W as principal elements which is called a Laves phase at a high temperature, and reduces the amount of solid solution Nb, Mo, W to reduce the high temperature strength, preferably the lower limit is 0.10%, suitably 0.12%, and further suitably 0.15%.

Mn is a very important element which forms $(Mn, Cr)_3O_4$ on a surface layer portion during a long time use and contributes to scale adhesion or inhibition of abnormal oxidation. The effect is exhibited when the content thereof is 0.20% or higher. On the other hand, excessive addition of Mn higher than 1.00% deteriorates processability at normal temperature. From the above-mentioned reason, preferably, the upper limit is suitably 0.87%, and further suitably 0.60%. Preferably, the lower limit is 0.20%, suitably 0.25%, and further suitably 0.30%.

Cr is an element which is a needed element for securing oxidation resistance in the invention. In the invention, since a sufficient oxidation resistance at 1000° C. is obtained when the content of Cr is 16.0% or higher, the lower limit is set to 16.0%. From the above-mentioned reason, the lower limit is suitably 16.5%, and further suitably 17.0%. On the other hand, since deterioration of processability and deterioration of toughness are caused when the content of Cr is higher than 20.0%, preferably the upper limit is 20.0%, suitably 19.5%, and further suitably 19.0%.

Nb is an element which is needed for improving high temperature strength by strengthening precipitation by solid solution strengthening and fine precipitation. Nb also has a role to fix C or N as carbonitride and to contribute to development of the corrosion resistance or the recrystallization texture having an influence on an r-value of a product sheet. In a Si—Mn—Nb—Mo—W—Cu-added steel of the invention, an increase of solid solution Nb and precipitation strengthening are obtained by addition of Nb 0.30% or higher. From the above-mentioned reason, preferably the lower limit is 0.30%, suitably 0.35%, and further suitably 0.40%. Excessive addition of Nb higher than 0.80% accelerates coarsening of a Laves phase, does not contribute to high temperature strength, and increases the cost. From the above-mentioned reason and manufacturability and the cost, preferably the upper limit is 0.80%, suitably 0.75%, and more suitably 0.70%.

Mo improves corrosion resistance, inhibits high temperature oxidation, and is effective for precipitation strengthening by fine precipitation of a fine precipitation and improvement of high temperature strength by solid solution strengthening. However, excessive addition of Mo accelerates scale spalling during a long time use, accelerates coarse precipitation, reduces a precipitation strengthening ability, and deteriorates the processability. In the invention, in the case of the above-mentioned Si—Mn—Nb—Mo—W—Cu-added steel, inhibition of high temperature oxidation at 1000° C., an increase of solid solution Mo, and precipitation strengthening are obtained by adding No 1.80% or higher. From the above-mentioned reason, preferably the lower limit is 1.80%, suitably 1.82%, and more suitably 1.86%.

However, excessive addition of Mo higher than 2.40% accelerates scale spalling, does not contribute to oxidation resistance, and causes increase in cost. From the above-mentioned reason, preferably the upper limit is 2.40%, suitably 2.35%, and more suitably 2.30%. In consideration of acceleration of coarsening of a Laves phase, no contribution to high temperature strength, and increase in cost, Mo is desirably 1.90 to 2.30%.

W has a similar effect to Mo, and is an element which improves high temperature strength. In a Si—Mn—Nb—Mo—W—Cu-added steel of the invention, an effect is obtained by addition of W 0.05% or higher. From the above-mentioned reason, preferably the lower limit is 0.05%, suitably 0.08%, and more suitably 0.10%. Note that, when W is added excessively, W is solutionized in a Laves phase, makes a precipitation coarse, and deteriorates manufacturability and processability. From the above-mentioned reason, preferably the upper limit is 1.40%, suitably 1.35%, and more suitably 1.30%. In consideration that W, in a similar manner to Mo, generates an oxide having a high sublimability and makes scale spalling easy, W is desirably 0.10 to 1.30%.

Cu is an element which is effective for improving high temperature strength. This is due to precipitation hardening effect by precipitation of ϵ-Cu, and the effect is considerably exhibited by addition 1.00% or higher. From the above-mentioned reason, preferably the lower limit is 1.00%, suitably 1.03%, and more suitably 1.05%.

On the other hand, excessive addition thereof causes deterioration of uniform stretching or an increase in a normal temperature proof stress, which generates a problem on the press formability. When Cu is added 2.50% or higher, an austenite phase is formed in a high temperature region and abnormal oxidation is created on the surface. From the above-mentioned reason, preferably the upper limit is 2.50%, suitably 2.40%, and more suitably 2.20%. In consideration also of manufacturability or scale adhesion, Cu is desirably 1.05 to 2.20%.

B is an element which improves secondary processability during press working of a product, and the effect of B is exhibited when 0.0003% or higher of B is added. From the above-mentioned reason, preferably the lower limit is 0.0003%, suitably 0.00035%, and more suitably 0.00040%. Note that excessive B addition causes hardening and deteriorates intergranular corrosion. In consideration of the above-mentioned reason and formability or manufacturing cost, preferably the upper limit is 0.0030%, suitably 0.0025%, and more suitably 0.0029%. In consideration of formability or manufacturing cost, desirably, B: 0.0004 to 0.0020%.

Figure 2:
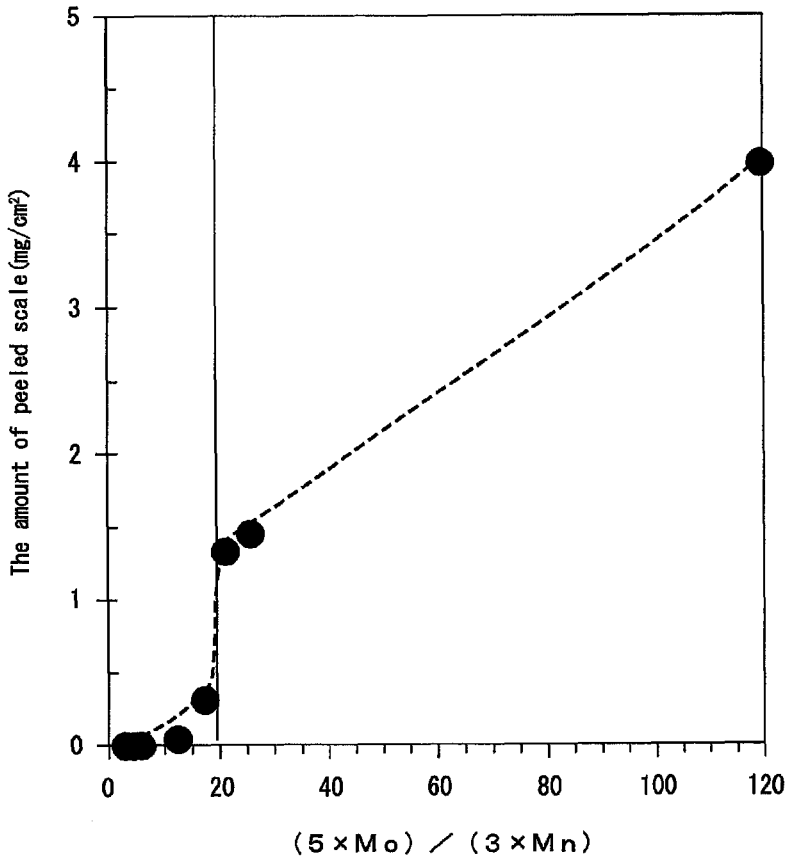
FIG. 2 illustrates a result representing an influence of the middle term of the formula (1) on the amount of spalled scale.

By excessive addition of Mo, $MoO_3$ having a high sublimability is generated, which is a cause of scale spalling. Accordingly, it has been found that, in order to remove an adverse effect of Mo, preferably the balance with Mn which has an effect of controlling $MoO_3$ is in an appropriate range: $3 \leq (5 \times Mo)/(3 \times Mn) \leq 20$ . . . (1) (FIG. 2). As illustrated in FIG. 2, in order to improve oxidation resistance in a component system of the invention, preferably the Mo/Mn ratio is 20 or lower. When this condition is satisfied, the scale spalling ability can be set to a target value, in other words, the amount of spalled scale in a continuous oxidation test in the air at 1000° C.×200 hours can be set to 1.0 g/cm$^2$ or lower. In this case, when a steel of the invention is used as an exhaust system material of an automobile, decrease in the thickness of the steel is reduced, and therefore the steel is usable. The upper limit and the lower limit of the Mo/Mn ratio is determined based on the component ranges of Mo and Mn. However, in order to ensure the effect, preferably the upper limit of the Mo/Mn ratio is suitably 15 or lower, and more suitably 10 or lower. By this, the amount of spalled scale in the above-mentioned test can be set to 1.0 g/cm$^2$ or lower.

From the viewpoint of securing high temperature strength and processability, preferably the lower limit of the Mo/Mn ratio is 3, suitably 4, and more suitably 5. In order for scale spalling not to occur, preferably the Mo/Mn ratio is in a range of 3 to 10.

Figure 3:
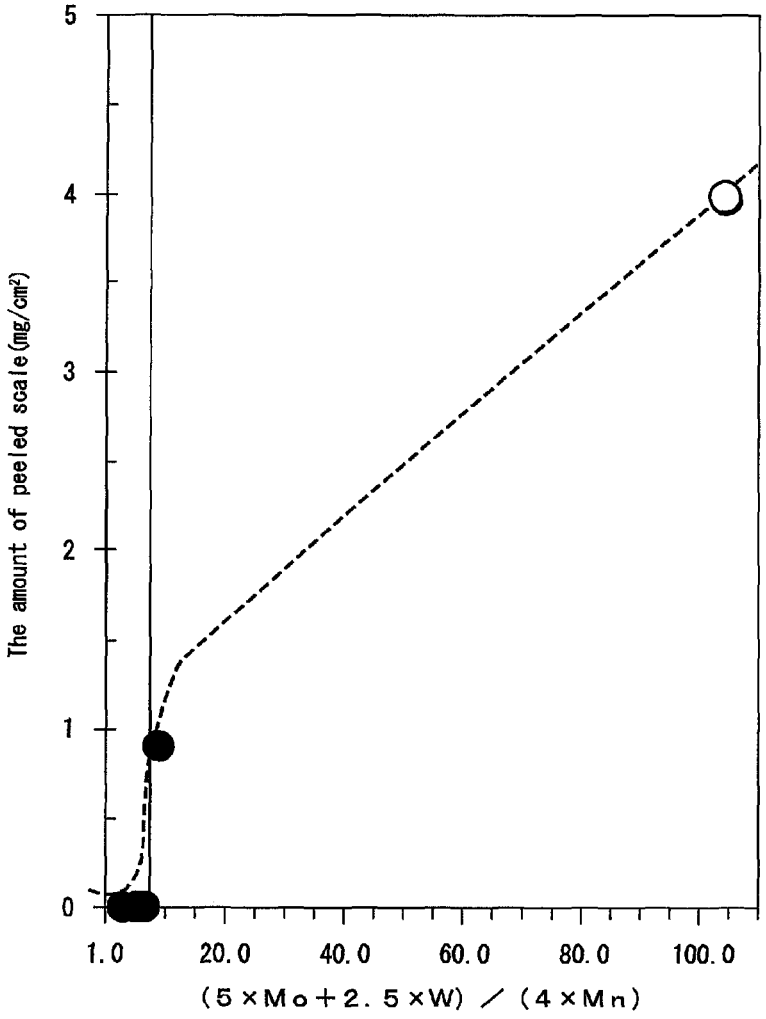
FIG. 3 illustrates a result representing an influence of the middle term of the formula (2) on the amount of spalled scale.

Further, in order to prevent an adverse effect of W, it has been found that, by making the balance between the elements in an appropriate range satisfying $2.28 \leq (5 \times Mo + 2.5W)/(4 \times Mn) \leq 8.0$ . . . (2), it is possible for scale spalling substantially not to occur (FIG. 3). From the above-mentioned reason, the upper limit is suitably 7.5, and more suitably 7.0. The lower limit can be determined by the component range of Mo, W, and Mn, and suitably 2.5, and more suitably 3.0.

In order to further improve a variety of characteristics such as high temperature strength, the following elements may be added.

Ni is an element which improves corrosion resistance, and when Ni is added excessively, an austenite phase is formed in a high temperature range and abnormal oxidation and scale spalling are generated. From the above-mentioned reason, preferably the upper limit is 1.0%, suitably 0.8%, and more suitably 0.6%. The effect is stably exhibited from Ni: 0.1%, and suitably the lower limit is 0.15%, and more suitably 0.20%. In consideration also of the manufacturing cost, the Ni content is desirably 0.2 to 0.6%.

Al is an element which is added as a deoxidation element, as well as improves oxidation resistance. Al is also useful for improving strength as a solid solution strengthening element. The effect is stably exhibited from 0.10%, and excessive addition of Al brings about hardening, considerably deteriorates uniform stretching, and considerably reduces toughness. From the above-mentioned reason, preferably the upper limit is 1.0%, suitably 0.60%, and more suitably 0.30%. When Al is added for the purpose of deoxidation, less than 0.10% of Al remains in the steel as an inevitable impurity. In consideration of occurrence of surface flaw, weldability, and manufacturability, preferably the lower limit is 0.01%, suitably 0.03%, and more suitably 0.10%.

V forms fine carbonitride together with Nb, and a precipitation strengthening effect is produced, thereby contributing to improvement of high temperature strength. However, when V is added more than 0.50%, Nb and V carbonitride is made coarse, whereby high temperature strength is decreased and processability is decreased. From the above-mentioned reason, preferably the upper limit is 0.50%, suitably 0.30%, and more suitably 0.20%. In consideration of manufacturing cost or oxidation resistance, preferably the lower limit is 0.01%, suitably 0.03%, and more suitably 0.05%.

Mg is an element which improves secondary processability. However, when Mg is added more than 0.0100%, processability is considerably deteriorated. From the above-mentioned reason, preferably the upper limit is 0.0100%, suitably 0.0050%, and more suitably 0.0010%. Further, in consideration of cost or surface quality, desirably the lower limit is 0.0001%, suitably 0.0003%, and more suitably 0.0004%.

Since Sn has a large atomic radius, Sn is an effective element which also contributes to high temperature strength by solid solution strengthening. Further, Sn does not largely deteriorate mechanical characteristics at normal temperature. However, when Sn is added more than 0.50%, manufacturability and processability are considerably deteriorated. From the above-mentioned reason, preferably the upper limit is 0.50%, suitably 0.30%, and more suitably 0.20%. Further, in consideration of oxidation resistance or the like, preferably the lower limit is 0.05%, suitably 0.03%, and more suitably 0.01%.

Co is an element which improves high temperature strength. However, when Co is added more than 1.50%, manufacturability and processability are considerably deteriorated. From the above-mentioned reason, preferably the upper limit is 1.50%, suitably 1.00%, and more suitably 0.50%. Further, in consideration of cost, preferably the lower limit is 0.01%, suitably 0.03%, and more suitably 0.05%

Zr is an element which improves oxidation resistance. However, when Zr is added more than 1.0%, a coarse Laves phase is precipitated, and manufacturability and processability are considerably deteriorated. From the above-mentioned reason, preferably the upper limit is 1.0%, suitably 0.80%, and more suitably 0.50%. Further, in consideration of cost or surface quality, preferably the lower limit is 0.01%, suitably 0.03%, and more suitably 0.05%.

Hf, in a similar manner to Zr, is an element which improves oxidation resistance. However, when Hf is added more than 1.0%, a coarse Laves phase is precipitated, and manufacturability and processability are considerably deteriorated. From the above-mentioned reason, preferably the upper limit is 1.0%, suitably 0.80%, and more suitably 0.50%. Further, in consideration of cost or surface quality, the lower limit is 0.01%, suitably 0.03%, and more suitably 0.05%.

Ta, in a similar manner to Zr and Hf, is an element which improves oxidation resistance. However, when Ta is added more than 2.0%, a coarse Laves phase is precipitated, and manufacturability and processability are considerably deteriorated. From the above-mentioned reason, preferably the upper limit is 2.0%, suitably 1.50%, and more suitably 1.00%. Further, in consideration of cost or surface quality, preferably the lower limit is 0.01%, suitably 0.03%, and more suitably 0.05%.

A ferritic stainless steel sheet of the invention is characterized in that, when subjected to a heat treatment in conditions of a temperature in the range of 900 to 1000° C. and 100 hours or longer, the sheet generates $(Mn, Cr)_3O_4$ on the outermost layer of an oxide film. In other words, this can confirm the existence of Mn-containing oxide film-forming ability. In addition, the ferritic stainless steel sheet of the invention is characterized in that the amount of spalled scale when a continuous oxidation test in the air is performed at 1000° C. for 200 (+10/−10) hours is 1.0 mg/cm$^2$ or smaller. In other words, this can confirm that the sheet has excellent scale spalling ability.

For a manufacturing method of a steel sheet of the invention, a general manufacturing method of ferritic stainless steel can be applied. For example, ferritic stainless steel having a composition range of the invention is dissolved to manufacture a slab which is heated at 1000 to 1200° C., and then is subjected to hot rolling (hot rolling) in the range of 1100 to 700° C. to manufacture a hot rolled sheet having a sheet thickness of 4 to 6 mm. Thereafter, after annealing at 800 to 1100° C. pickling is performed, the annealed and pickled sheet is subjected to cold rolling (cold rolling) to make a cold rolled sheet having a sheet thickness of 1.5 to 2.5 mm. And then, after a finishing annealing at 900 to 1100° C., a steel sheet can be manufactured by a process of pickling. Note that, when the cooling speed after the final annealing is low, a lot of precipitation such as a Laves phase is precipitated, and therefore, high temperature strength may be decreased and a processability such as ductility at normal temperature may be deteriorated. For this reason, the average cooling speed from the final annealing temperature to 600° C. is desirably controlled to 5° C./sec or higher. Preferably, hot rolling conditions of a hot rolled sheet, the thickness of a hot rolled sheet, existence or absence of annealing of a hot rolled sheet, cold rolling conditions, the annealing temperatures of a hot rolled sheet and a cold rolled sheet, atmosphere, and the like are appropriately selected. Cold rolling-annealing may be repeated a plurality of times, or temper rolling or tension leveler may be applied after the cold rolling•annealing. Further, the thickness of a product sheet may also be selected depending on the thickness of a demanded member.

EXAMPLES

<Sample Producing Method>

Each of steels of component compositions listed on Table 1 and Table 2 was smelted to cast a 50 kg of slab, and the slab was subjected to hot rolling at 1100 to 700° C. to form a hot rolled sheet having a sheet thickness of 5 mm. Thereafter, the hot rolled sheet was annealed at 900 to 1000° C. and then pickled to be subjected to cold rolling until the sheet thickness became 2 mm, followed by annealing•pickling, thereby forming a product sheet. The annealing temperature of a cold rolled sheet was controlled at 1000 to 1200° C., and the cooling speed from the annealing temperature to 600° C. was controlled at 5° C./sec or higher. No. 2 to 21, and 23 on Table 1 are Examples of the present invention, and No. 24 to 49 on Table 2 represent Comparative Examples. In Table 2, values outside the range of the invention are underlined. In Tables 1 and 2, "-" means "not positively added" which is an inevitable impurities-level. Values in which the middle term of the formula (2) is outside a preferred range are in bold.

<Oxidation Resistance Testing Method>

From the thus obtained product sheet, an oxidation test piece of 20 mm×20 mm and a thickness of the sheet thickness was made, and the test piece was subjected to a continuous oxidation test in an atmosphere at 1000° C. for 200 (+10/−10) hours to evaluate the existence or absence of abnormal oxidation and scale spalling (in accordance with JIS Z 2281). When the increased amount of oxidation was 4.0 mg/cm$^2$ or smaller, the evaluation was defined B (suitable) as not having abnormal oxidation; otherwise, the evaluation was defined C (not suitable) as having abnormal oxidation. When the amount of spalled scale was 1.0 mg/cm$^2$ or smaller, the evaluation was defined A (excellent); otherwise, the evaluation was defined C (not suitable) as having scale spalling.

<Method of Confirming Mn-Containing Oxide Film>

A test piece in which a cross section of the test piece subjected to a continuous oxidation test by an oxidation resistance testing method was mirror polished after the test piece was embedded in a resin was subjected to an elemental mapping by EPMA, and whether or not Mn was concentrated at the outermost layer was confirmed. The outermost layer portion of a scale was subjected to an elemental mapping of Fe, Cr, Mn, Si, and O with a magnification of ×2000, and when Mn was concentrated at 8 mass % or higher on the outermost layer, the evaluation was defined B (suitable) as there was a Mn-containing oxide film; otherwise, the evaluation was defined C (not suitable) as there was no Mn-containing oxide film.

<High Temperature Tensile Testing Method>

A high temperature tensile test piece with a length of 100 mm whose longitudinal direction was in the rolling direction was made from a product sheet, and was subjected to a 1000° C. tensile test to measure a 0.2% proof stress (in accordance with JIS G 0567). Here, when the 0.2% proof stress at 1000° C. was 11 MPa or larger, the evaluation was defined B (suitable); when the 0.2% proof stress at 1000° C. was less than 11 MPa, the evaluation was defined C (not suitable).

<Evaluation Method of Processability at Normal Temperature>

A JIS13B test piece whose longitudinal direction was parallel to the rolling direction was made in accordance with JIS Z 2201. By using these test pieces, a tensile test was performed to measure breaking elongation (in accordance with JIS Z 2241). Here, when the breaking elongation at normal temperature is 30% or larger, processing on a general exhaust component is possible. Therefore, when the breaking elongation was 30% or larger, the evaluation was defined B (suitable); when the breaking elongation was smaller than 30%, the evaluation was defined C (not suitable).

TABLE 1

| | | Component content (mass %) | | | | | | | | | | | | | | | |
|---|---|---|---|---|---|---|---|---|---|---|---|---|---|---|---|---|---|
| | No | C | N | Si | Mn | Cr | Nb | Mo | W | Cu | B | Ni | Al | V | Mg | Sn | Co |
| Example of the present invention | 2 | 0.006 | 0.011 | 0.13 | 0.31 | 17.1 | 0.56 | 2.28 | 0.72 | 1.52 | 0.0005 | — | — | — | — | — | — |
| | 3 | 0.005 | 0.012 | 0.23 | 0.22 | 17.5 | 0.43 | 1.98 | 0.83 | 1.74 | 0.0003 | — | — | — | — | — | — |
| | 4 | 0.007 | 0.009 | 0.12 | 0.27 | 17.9 | 0.55 | 2.10 | 0.65 | 1.47 | 0.0006 | — | — | — | — | — | — |
| | 5 | 0.006 | 0.010 | 0.20 | 0.49 | 16.9 | 0.53 | 2.03 | 0.95 | 1.51 | 0.0004 | — | — | — | — | — | — |
| | 6 | 0.005 | 0.010 | 0.16 | 0.50 | 17.3 | 0.49 | 2.19 | 0.84 | 1.68 | 0.0015 | — | — | — | — | — | — |
| | 7 | 0.005 | 0.013 | 0.13 | 0.30 | 17.0 | 0.54 | 2.23 | 0.80 | 1.55 | 0.0005 | — | — | — | — | — | — |
| | 8 | 0.005 | 0.011 | 0.11 | 0.52 | 17.2 | 0.60 | 1.90 | 1.29 | 1.52 | 0.0004 | — | — | — | — | — | — |
| | 9 | 0.006 | 0.010 | 0.12 | 0.52 | 17.8 | 0.56 | 2.20 | 0.67 | 1.56 | 0.0005 | 0.14 | — | — | — | — | — |
| | 10 | 0.006 | 0.010 | 0.14 | 0.33 | 16.6 | 0.56 | 2.17 | 0.65 | 2.20 | 0.0023 | — | 0.25 | — | — | — | — |
| | 11 | 0.006 | 0.011 | 0.15 | 0.30 | 17.0 | 0.69 | 1.82 | 1.06 | 1.05 | 0.0005 | — | — | 0.10 | — | — | — |
| | 12 | 0.008 | 0.013 | 0.31 | 0.47 | 16.8 | 0.34 | 2.17 | 0.64 | 1.68 | 0.0005 | — | — | — | 0.0005 | — | — |
| | 13 | 0.005 | 0.011 | 0.18 | 0.25 | 17.5 | 0.48 | 2.14 | 0.68 | 1.35 | 0.0009 | — | — | — | — | 0.08 | — |
| | 14 | 0.005 | 0.010 | 0.18 | 0.32 | 17.4 | 0.57 | 2.27 | 1.25 | 1.47 | 0.0007 | — | — | — | — | — | 0.12 |
| | 15 | 0.007 | 0.010 | 0.12 | 0.28 | 16.2 | 0.48 | 2.00 | 0.78 | 1.43 | 0.0004 | — | — | — | — | — | — |
| | 16 | 0.006 | 0.010 | 0.11 | 0.27 | 17.4 | 0.53 | 1.87 | 0.71 | 1.49 | 0.0004 | — | — | — | — | — | — |
| | 17 | 0.005 | 0.013 | 0.36 | 0.46 | 16.2 | 0.45 | 2.06 | 0.62 | 1.24 | 0.0008 | — | — | — | — | — | — |
| | 18 | 0.005 | 0.012 | 0.14 | 0.39 | 17.5 | 0.54 | 1.81 | 0.70 | 1.53 | 0.0005 | — | — | — | — | — | — |
| | 19 | 0.005 | 0.008 | 0.11 | 0.51 | 18.3 | 0.55 | 1.86 | 1.30 | 1.55 | 0.0005 | — | — | — | — | — | — |
| | 20 | 0.006 | 0.010 | 0.15 | 0.35 | 17.5 | 0.55 | 2.01 | 0.35 | 1.49 | 0.0005 | — | — | — | — | — | — |
| | 21 | 0.006 | 0.010 | 0.14 | 0.25 | 17.8 | 0.56 | 2.13 | 0.68 | 1.49 | 0.0005 | — | — | — | — | — | — |
| | 23 | 0.006 | 0.010 | 0.14 | 0.20 | 18.2 | 0.49 | 2.40 | 1.40 | 1.45 | 0.0005 | — | — | — | — | — | — |

| | | Component content (mass %) | | | Mc/Mn ratio formula | W · Mo/Mn ratio formula | Abnormal oxidation after continuous oxidation test at 1000° C. | Amount of spalled scale after continuous oxidation test at 1000° C. | Existence of Mn-containing oxide film after continuous oxidation test at 1000° C. for | 0.2% proof stress at | Breaking elongation at normal |
|---|---|---|---|---|---|---|---|---|---|---|---|
| | No | Zr | Hf | Ta | (1) | (2) | for 200 hr | for 200 hr | 200 hr | 1000° C. | temperature |
| Example of the present invention | 2 | | — | — | 12.3 | 10.6 | B | B | B | B | B |
| | 3 | | — | — | 15.0 | 13.6 | B | B | B | B | B |
| | 4 | — | — | — | 13.0 | 11.2 | B | B | B | B | B |
| | 5 | — | — | — | 6.9 | 6.4 | B | A | B | B | B |
| | 6 | — | — | — | 7.3 | 6.5 | B | A | B | B | B |
| | 7 | — | — | — | 12.4 | 11.0 | B | 8 | B | B | B |
| | 8 | — | — | — | 6.1 | 6.1 | B | A | B | B | B |
| | 9 | — | — | — | 7.1 | 6.1 | B | A | B | B | B |
| | 10 | — | — | — | 11.0 | 9.5 | B | B | B | B | B |
| | 11 | — | — | — | 10.1 | 9.8 | B | B | B | B | B |
| | 12 | — | — | — | 7.1 | 6.6 | B | A | B | B | B |
| | 13 | — | — | — | 14.3 | 12.4 | B | B | B | B | B |
| | 14 | — | — | | 11.8 | 11.3 | B | B | B | B | B |
| | 15 | 0.36 | — | | 11.9 | 10.7 | B | B | B | B | B |
| | 16 | — | 0.27 | — | 11.5 | 10.3 | B | B | B | B | B |
| | 17 | — | — | 0.45 | 7.5 | 6.4 | B | A | B | B | B |
| | 18 | — | — | — | 7.7 | 6.9 | B | A | B | B | B |
| | 19 | — | — | — | 6.1 | 6.2 | B | A | B | B | B |
| | 20 | — | — | — | 9.6 | 7.8 | B | A | B | B | B |
| | 21 | — | — | — | 14.2 | 12.4 | B | B | B | B | B |
| | 23 | — | — | — | 20.0 | 19.4 | B | B | B | B | B |

TABLE 2

| | | Component content (mass %) | | | | | | | | | | | | | | | |
|---|---|---|---|---|---|---|---|---|---|---|---|---|---|---|---|---|---|
| | No | C | N | Si | Mn | Cr | Nb | Mo | W | Cu | B | Ni | Al | V | Mg | Sn | Co |
| Comparative Example | 24 | 0.026 | 0.011 | 0.15 | 0.22 | 16.7 | 0.43 | 2.12 | 0.52 | 1.33 | 0.0007 | — | — | — | — | — | — |
| | 25 | 0.005 | 0.028 | 0.14 | 0.35 | 17.5 | 0.50 | 2.33 | 0.67 | 1.35 | 0.0003 | — | — | — | — | — | — |
| | 26 | 0.005 | 0.011 | 0.05 | 0.31 | 17.1 | 0.48 | 1.91 | 0.72 | 1.52 | 0.0004 | — | — | — | — | — | — |
| | 27 | 0.004 | 0.012 | 0.53 | 0.35 | 18.0 | 0.42 | 2.20 | 0.46 | 1.43 | 0.0004 | — | — | — | — | — | — |
| | 28 | 0.006 | 0.012 | 0.14 | 0.15 | 17.4 | 0.55 | 2.15 | 0.70 | 1.47 | 0.0005 | — | — | — | — | — | — |
| | 29 | 0.006 | 0.009 | 0.13 | 1.18 | 17.0 | 0.49 | 2.15 | 0.67 | 1.40 | 0.0004 | — | — | — | — | — | — |

TABLE 2-continued

| | | | | | | | | | | | | | | | | |
|---|---|---|---|---|---|---|---|---|---|---|---|---|---|---|---|---|
| 30 | 0.005 | 0.008 | 0.14 | 0.31 | 14.0 | 0.53 | 2.16 | 0.65 | 1.45 | 0.0005 | — | — | — | — | — | — |
| 31 | 0.005 | 0.013 | 0.23 | 0.60 | 24.1 | 0.47 | 2.00 | 0.60 | 1.71 | 0.0005 | — | — | — | — | — | — |
| 32 | 0.004 | 0.012 | 0.18 | 0.52 | 17.2 | 0.16 | 2.24 | 0.35 | 1.80 | 0.0009 | — | — | — | — | — | — |
| 33 | 0.004 | 0.012 | 0.16 | 0.49 | 17.3 | 0.87 | 2.30 | 0.21 | 1.13 | 0.0005 | — | — | — | — | — | — |
| 34 | 0.005 | 0.010 | 0.15 | 0.99 | 17.5 | 0.54 | 1.74 | 0.38 | 1.68 | 0.0003 | — | — | — | — | — | — |
| 35 | 0.004 | 0.011 | 0.21 | 0.23 | 17.5 | 0.61 | 2.85 | 0.15 | 1.25 | 0.0007 | — | — | — | — | — | — |
| 36 | 0.007 | 0.010 | 0.14 | 0.28 | 16.8 | 0.56 | 2.14 | 0.02 | 1.60 | 0.0003 | — | — | — | — | — | — |
| 37 | 0.008 | 0.010 | 0.17 | 0.25 | 17.9 | 0.55 | 2.21 | 1.80 | 1.21 | 0.0005 | — | — | — | — | — | — |
| 38 | 0.007 | 0.012 | 0.13 | 0.26 | 18.0 | 0.54 | 2.30 | 0.35 | 0.45 | 0.0005 | — | — | — | — | — | — |
| 39 | 0.005 | 0.009 | 0.12 | 0.24 | 17.4 | 0.55 | 2.10 | 0.36 | 3.21 | 0.0006 | — | — | — | — | — | — |
| 40 | 0.006 | 0.013 | 0.20 | 0.45 | 17.3 | 0.50 | 2.11 | 0.60 | 1.50 | 0.0050 | — | — | — | — | — | — |
| 41 | 0.005 | 0.010 | 0.16 | 0.33 | 17.4 | 0.51 | 2.09 | 0.58 | 1.51 | 0.0004 | 2.1 | — | — | — | — | — |
| 42 | 0.005 | 0.010 | 0.15 | 0.45 | 17.0 | 0.51 | 2.03 | 0.59 | 1.45 | 0.0004 | — | 2.01 | — | — | — | — |
| 43 | 0.004 | 0.011 | 0.15 | 0.29 | 16.8 | 0.43 | 2.04 | 0.34 | 1.78 | 0.0004 | — | — | 0.76 | — | — | — |
| 44 | 0.007 | 0.009 | 0.12 | 0.48 | 17.3 | 0.56 | 2.11 | 0.56 | 1.30 | 0.0003 | — | — | — | 0.0127 | — | — |
| 45 | 0.005 | 0.013 | 0.13 | 0.25 | 17.2 | 0.54 | 2.13 | 0.28 | 1.45 | 0.0005 | — | — | — | — | 0.68 | — |
| 46 | 0.004 | 0.017 | 0.19 | 0.34 | 16.8 | 0.52 | 2.20 | 0.58 | 1.50 | 0.0006 | — | — | — | — | — | 2.61 |
| 47 | 0.004 | 0.004 | 0.12 | 0.42 | 17.3 | 0.42 | 2.15 | 0.35 | 1.38 | 0.0006 | — | — | — | — | — | — |
| 48 | 0.005 | 0.012 | 0.11 | 0.38 | 17.5 | 0.57 | 1.95 | 0.57 | 1.54 | 0.0004 | — | — | — | — | — | — |
| 49 | 0.003 | 0.010 | 0.14 | 0.34 | 17.2 | 0.40 | 2.00 | 0.28 | 1.47 | 0.0006 | — | — | — | — | — | — |

| | No | Component content (mass %) Zr | Hf | Ta | Mc/Mn ratio formula (1) | W · Mo/Mn ratio formula (2) | Abnormal oxidation after continuous oxidation test at 1000° C. for 200 hr | Amount of spalled scale after continuous oxidation test at 1000° C. for 200 hr | Existence of Mn-containing oxide film after continuous oxidation test at 1000° C. for 200 hr | 0.2% proof stress at 1000° C. | Breaking elongation at normal temperature |
|---|---|---|---|---|---|---|---|---|---|---|---|
| Comparative Example | 24 | — | — | — | 16.1 | 13.5 | B | B | B | C | C |
| | 25 | — | — | — | 11.1 | 9.5 | B | B | B | C | C |
| | 26 | — | — | — | 10.3 | 9.2 | C | B | B | B | B |
| | 27 | — | — | — | 10.5 | 8.7 | B | C | B | C | B |
| | 28 | — | — | — | 23.9 | 20.8 | C | C | C | B | B |
| | 29 | — | — | — | 3.0 | 2.6 | B | A | B | B | C |
| | 30 | — | — | — | 11.6 | 10.0 | C | C | B | B | B |
| | 31 | — | — | — | 5.6 | 4.8 | B | A | B | B | C |
| | 32 | — | — | — | 7.2 | 5.8 | B | A | B | C | B |
| | 33 | — | — | — | 7.8 | 6.1 | B | A | B | B | C |
| | 34 | — | — | — | 2.9 | 2.4 | B | A | B | C | B |
| | 35 | — | — | — | 20.7 | 15.9 | B | C | C | B | C |
| | 36 | — | — | — | 12.7 | 9.6 | B | B | B | C | B |
| | 37 | — | — | — | 14.7 | 15.6 | B | C | B | B | C |
| | 38 | — | — | — | 14.7 | 11.9 | B | B | B | C | B |
| | 39 | — | — | — | 14.6 | 11.9 | C | B | B | B | C |
| | 40 | — | — | — | 7.8 | 6.7 | B | A | B | B | C |
| | 41 | — | — | — | 10.6 | 9.0 | C | C | B | B | B |
| | 42 | — | — | — | 7.5 | 6.5 | B | A | B | B | C |
| | 43 | — | — | — | 11.7 | 9.5 | B | B | B | B | C |
| | 44 | — | — | — | 7.3 | 6.2 | B | A | B | B | C |
| | 45 | — | — | — | 14.2 | 11.4 | B | B | B | B | C |
| | 46 | — | — | — | 10.8 | 9.2 | B | B | B | B | C |
| | 47 | 1.02 | — | — | 8.5 | 6.9 | B | A | B | B | C |
| | 48 | — | 1.27 | — | 8.6 | 7.4 | B | A | B | B | C |
| | 49 | — | — | 2.68 | 9.8 | 7.9 | B | A | B | B | C |

<Evaluation Result>

As is clear from Table 1 and Table 2, in a steel having a component composition defined by the invention, the increased amount of oxidation or the amount of spalled scale at 1000° C. are small compared with Comparative Examples, and the Comparative Example is excellent. It was found that, in No. 5, 6, 8, 9, 12, 17, 18, and 19 of Examples of the present invention satisfying the formula (2), all the evaluation results of the amount of spalled scale were A (excellent), and the amount of spalled scale was substantially zero compared with other Examples of the present invention (the evaluation result of the amount of spalled scale was B (suitable)). When No. 20 and No. 21 of Examples of the present invention in which components other than Mn, Mo, and W are similar are compared to each other, it is found that the scaling resistance amount of No. 20 satisfying formulae (1) and (2) is more excellent than that of No. 21 only satisfying formula (1). Further, it is found that, regarding the mechanical property at normal temperature, in the Examples of the present invention, the fracture ductility is favorable and processability which is equal to or better than those of Comparative Examples is obtained.

Since, in No. 24, 25 steels, each of C, N exceeds the upper limit, the proof stress and ductility at normal temperature at 1000° C. are lower than those of Examples of the present invention. In No. 24 steel, Si is below the lower limit, and the increased amount of oxidation is larger than those of Examples of the present invention. In No. 27 steel, Si exceeds the upper limit, the amount of spalled scale is larger than those of Examples of the present invention, and also the high temperature proof stress is more deteriorated than those of Examples of the present invention. In No. 28 and 30 steels, each of Mn and Cr is below the lower limit, and the increased amount of oxidation and the amount of spalled scale are larger than those of Examples of the present invention. In No. 29 steel, Mn is excessively added, and ductility at normal temperature is low. In No. 31 steel, Cr exceeds the upper limit, and although the amount of spalled scale is small, the ductility at normal temperature is low. In No. 32, 34, 36, and 38 steels, each of Nb, Mo, W, and Cu is below the lower limit, and the proof stress at 1000° C. is low. In No. 33 and 37 steels, each of Nb and W exceeds the upper limit, and although the increased amount of oxidation and the amount of spalled scale are small, the ductility at normal temperature is low. Since, in No. 35 steel, Mo exceeds the upper limit, and in addition, the formula (1) is not satisfied, the amount of spalled scale is large, and the ductility at normal temperature is low. In No. 39 steel, Cu exceeds the upper limit, the increased amount of oxidation is large, and the ductility at normal temperature is deteriorated. In No. 40 steel, B exceeds the upper limit, and although the increased amount of oxidation and the amount of spalled scale are small, the ductility at normal temperature is low. In No. 41 steel, Ni exceeds the upper limit, and the increased amount of oxidation and the amount of spalled scale are large. In No. 42 to 49, each of Al, V, Mg, Sn, Co, Zr, Hf, and Ta exceeds the upper limit, and although the increased amount of oxidation and the amount of spalled scale are small, the ductility at normal temperature is low.

INDUSTRIAL APPLICABILITY

Since the ferritic stainless steel of the present invention has excellent heat resistance, the steel can be used also as an exhaust gas channel member of a power plant other than a processed good of an exhaust system member of an automobile. Further, since Mo which is effective for improving corrosion resistance is added, the steel can be used also for applications which need corrosion resistance.

The invention claimed is:

1. A Mn-containing ferritic stainless steel sheet consisting of, in terms of mass %:

C: 0.001 to 0.020%,
N: 0.001 to 0.020%,
Si: 0.10 to 0.40%,
Mn: 0.20 to 1.00%,
Cr: 16.0 to 20.0%,
Nb: 0.30 to 0.80%,
Mo: 1.80 to 2.40%,
W: 0.05 to 1.40%,
Cu: 1.00 to 2.50%, and
B: 0.0003 to 0.0030%, satisfying formula (1) below, and a balance is composed of Fe and inevitable impurities, $$5 \leq (5 \times Mo)/(3 \times Mn) \leq 20 \quad (1),$$

wherein Mo and Mn in the formula (1) each mean the content (mass %) thereof.

2. The Mn-containing ferritic stainless steel sheet according to claim 1, satisfying formula (2) below, $$2.28 \leq (5 \times Mo + 2.5 \times W)/(4 \times Mn) \leq 8.0 \quad (2),$$

wherein Mo, Mn, and W in the formula (2) each mean the content (mass %) thereof.

3. The Mn-containing ferritic stainless steel sheet according to claim 2, wherein $(Mn, Cr)_3O_4$ is generated on an outermost layer of an oxide film when a heat treatment is performed in a condition of 900 to 1000° C.×100 hours or longer.

4. The Mn-containing ferritic stainless steel sheet according to claim 2, wherein an amount of spalled scale in cases in which the ferritic stainless steel sheet is subjected to a continuous oxidation test in air at 1000° C. for 200 hours is 1.0 mg/cm$^2$ or smaller.

5. The Mn-containing ferritic stainless steel sheet according to claim 1, wherein $(Mn, Cr)_3O_4$ is generated on an outermost layer of an oxide film when a heat treatment is performed in a condition of 900 to 1000° C.×100 hours or longer.

6. The Mn-containing ferritic stainless steel sheet according to claim 5, wherein an amount of spalled scale in cases in which the ferritic stainless steel sheet is subjected to a continuous oxidation test in air at 1000° C. for 200 hours is 1.0 mg/cm$^2$ or smaller.

7. The Mn-containing ferritic stainless steel sheet according to claim 1, wherein an amount of spalled scale in cases in which the ferritic stainless steel sheet is subjected to a continuous oxidation test in air at 1000° C. for 200 hours is 1.0 mg/cm$^2$ or smaller.

* * * * *